United States Patent [19]

Lin

[11] 3,957,195

[45] May 18, 1976

[54] FOLDABLE PLASTIC AND PAPER CONTAINER ASSEMBLY

[76] Inventor: Tenhon Lin, 53, Tai Ping Road, Hsin Tien, Taipei Hsien, China /Taiwan

[22] Filed: Jan. 27, 1975

[21] Appl. No.: 544,395

[52] U.S. Cl. ..... 229/14 B; 229/1.5 R

[51] Int. Cl.[2] ..... B65D 5/40

[58] Field of Search ..... 229/1.5 B, 14 B, 14 BA, 229/14 BE, 14 BL, 14 BW

[56] References Cited

UNITED STATES PATENTS

| | | | |
|---|---|---|---|
| 1,116,068 | 11/1914 | Jackson | 150/10 UX |
| 2,079,177 | 5/1937 | Membrino | 229/1.5 R X |
| 2,305,371 | 12/1942 | Yates | 229/14 B |
| 2,339,156 | 1/1944 | Davis | 229/14 BE X |
| 2,353,178 | 7/1944 | Moore | 229/14 BA |
| 2,678,764 | 5/1954 | Carlson | 229/14 BE X |
| 3,061,165 | 10/1962 | Rench et al. | 229/14 B |
| 3,358,905 | 12/1967 | Soesbergen | 229/14 B UX |
| 3,370,773 | 2/1968 | Mayo | 229/14 B |

*Primary Examiner*—Davis T. Moorhead
*Attorney, Agent, or Firm*—Shoemaker and Mattare, Ltd.

[57] ABSTRACT

A container assembly composed of a plastic bag and a hollow paper body, at the outer surface of said paper body is attached the open end of a plastic bag by virtue of a hot-melt adhesive material to serve a simple, water-proof container for use, and which can be folded into a very small volume by means of its preset folding lines.

5 Claims, 9 Drawing Figures

FOLDABLE PLASTIC AND PAPER CONTAINER ASSEMBLY

Most conventional containers are either made of paper or plastic material, and in practical use, in order to increase packaging strength and to maintain water-proofness, said plastic bag is often put into the inner space or packed on the outer surface of said paper container; thus causing much inconvenience.

The present invention relates to a container assembly and more particularly to a foldable container made by combining paper board and a plastic bag.

The primary object of the present invention is to provide a container comprised of a plastic bag and a hollow paper tube, which can be collapsed into a small volume and easily carried therefor empty. When in use it can be erected to carry various articles and be sealed easily.

Another object of the present invention is to provide a container assembly which can be used to package any solid or liquid material.

A further object of the present invention is to provide a container assembly wherein advertisements may be printed on its outer surfaces for multiple purposes, particularly for picnic and travels.

Other features and advantages of the invention will be more apparent from the following description taken in connection with the accompanying drawings wherein.

Figure 1:
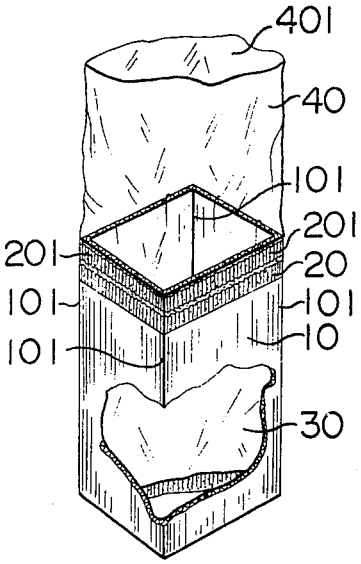
FIG. 1 is a partly cross-sectional view of a first embodiment according to the present invention.
Figure 3:
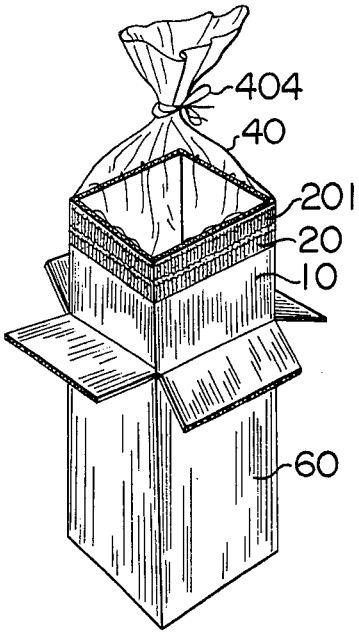
FIG. 3 is an application of the present invention.

As shown in FIG. 1, the container assembly is of a hollow cylindrical form (or triangular, square, polygonal, circular or any other forms) made of a sheet of thick paper board or a piece of corrugated board, and at appropriate locations of the outer surfaces of the cylindrical body 10 is coated a belt of hot-melt adhesive material 20, to which is joined the opening end of a plastic bag 30 and a plastic film sealing means 40 having an opening 401 sealed by means of a soldering iron for forming at least one heat seal 201-201. Said plastic bag 30 is sealed at the bottom; thus various solid or liquid articles can be filled therein. Said plastic film 40 can be sealed tightly by means of a tie 404 as shown in FIG. 3 or by a high frequency, hot-melt method or the like, to form a completed container. The outer surface of the container may also be printed with various colorful advertisements.

Figure 2:
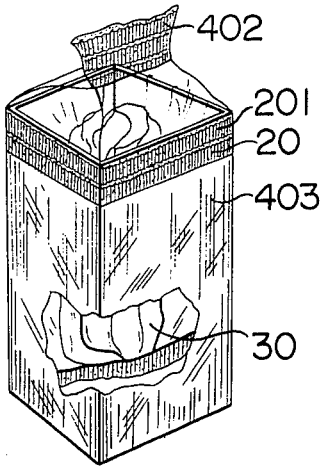
FIG. 2 is a partly cross-sectional view of a second embodiment according to the present invention.

FIG. 2 is a partly cut-away view of a second embodiment of the present invention the construction of which is in most part the same as in the first embodiment, the only difference being that either the open end of said plastic bag 30 or the lower end of said plastic film 40 is integrally extended from the adhesive portion 20 to the lower edge of the paper body 10 to form a transparent plastic film 403 over the outer surface of said paper body 10 to thereby water-proof that surface.

Figure 4:
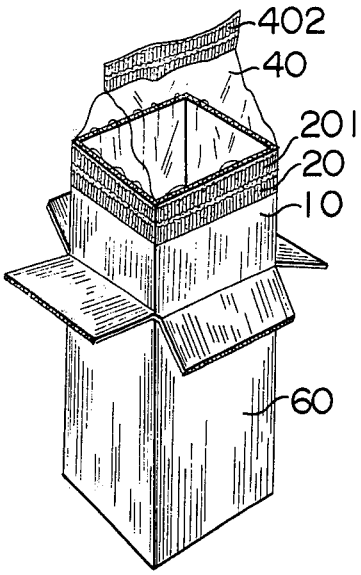
FIG. 4 is another application of the present invention.

FIGS. 3 and 4 are two applications of the embodiments of the present invention. The plastic film 40 can be tied up with a rope 404 or the like, or sealed by means of a high-frequency, hot-melt joint 402. Then the completed container can be placed in a conventional corrugated carton 60 to form a two-ply packing in order to increase its strength and to facilitate transportation.

Figure 5:
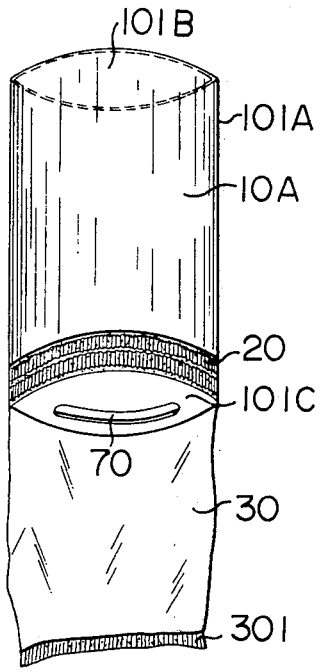
FIG. 5 is a perspective view of a third embodiment of the present invention.

FIG. 5 is a perspective view of the third embodiment of the present invention. Said hollow cylindrical paper body 10A is approximately circular and has two folding lines 101A-101A. At appropriate locations on the outer surface of said paper body 10A is also coated a belt of hot-melt adhesive 20 attaching a plastic bag 30 with its bottom 301 sealed. As shown in this figure, solid articles can be placed in the container from the upper open end 101B of the cylindrical paper body 10A; if the plastic bag 30 is inserted into the inner space of said paper body 10A, and if the container is turned upside-down, liquid beverage can be filled in the bag 30 without wetting the inner wall of said paper body 10A, and the user may drink the beverage out of the bag 10A, because a flexible metallic strip 70 is in-laid at one end edge of the paper body 10A, and the strip 70 can be curved as a channel (as shown in FIG. 6) to guide the liquid flow without leaking from a drinker's mouth.

Figure 7:
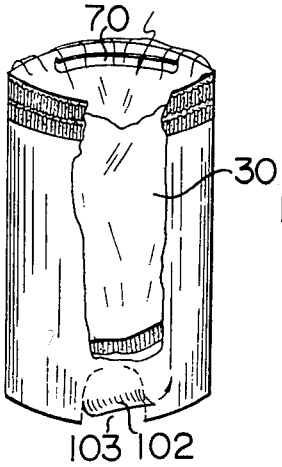
FIG. 6 and FIG. 7 are perspective views of a fourth embodiment according to the present invention.
Figure 6:
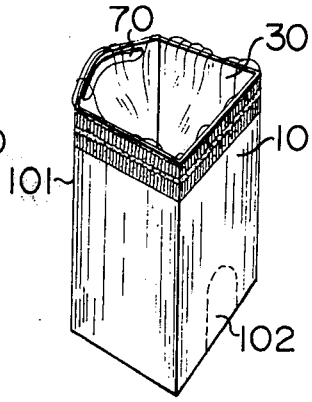
Figure 8:
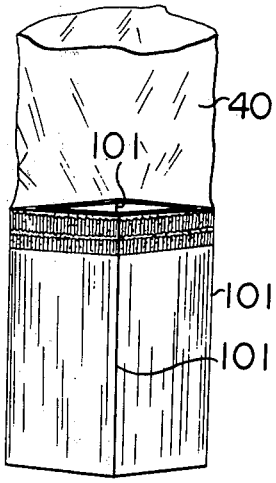
FIG. 8 is a perspective view of a collapsed situation of the present invention.

FIGS. 6 and 7 are perspective views of a fourth embodiment of the present invention. Except that a lifting tab 102 is provided at the lower end of the paper body 10, and other features remain the same; said tab 102 can be displaced upward to form a groove 103, through which a user's fingers can be extended a for better hold and support without slipping when the plastic bag 30 is loaded with heavy material;

All the embodiments of the present invention mentioned above can be casually used as a cup, a container and for use in other purposes. Moreover, said container assembly can be collapsed by means of fold lines 101-101 as shown in FIG. 8 to a very small volume for carrying. In order to increase the packaging strength of the plastic bag and of said sealing means, two or more plies may be used.

Figure 9:
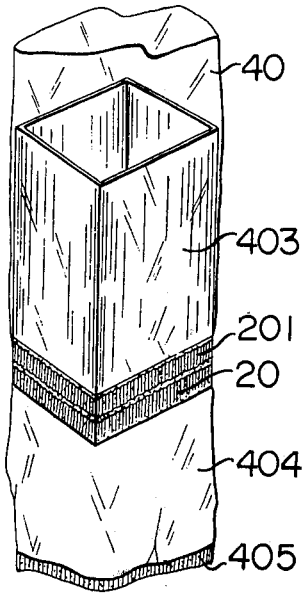
FIG. 9 is a perspective view of a fifth embodiment according to the present invention.

FIG. 9 is a fifth embodiment of the present invention, wherein said plastic film 40 is integrally extended downward a proper length and has its bottom portion 405 sealed and attached on the outer surface of the paper body 10 by hot-melt adhesives 20 to form a sealing means 40, a water-proof film 403 and a bag body 404.

It is to be understood that the most important feature of the present invention is that on the outer surface of a hollow polygonal or cylindrical paper body is attached a plastic bag by a hot-melt adhesives to serve as a container assembly; therefore, the form of the paper body; the location of the hot-melt adhesive coating; the size, length, plies of the plastic bag or the plastic film sealing means; the extending length of said plastic bag or sealing means; whether a flexible metallic strip is in-laid near the opening of the body or not or the sealing type of said plastic sealing means, all can be modified according to actual needs; however, these are still within the scope and spirit of the present invention.

The uses of the container assembly according to the present invention are very broad, such as, to replace containers, cups, large or small, for filling in solid or liquid articles or materials in the households, during a trip or picnic, and for industrial or commercial purposes. In addition, it is of low cost, disposable after use, and easy to carry when collapsed into a very small volume.

I claim:

1. A foldable plastic and paper container assembly characterized in that the container assembly is formed by rolling up a sheet of thick paper or a piece of corrugated board and the like into a hollow polygonal or cylindrical body open at both ends, comprising:

an inner plastic bag located inside of the cylindrical body and having a top end located outside of said body;

an outer plastic bag located outside of the cylindrical body;

a first belt of hot-melt adhesive on the outer surface of the body for sealing said inner bag top end to the body and to an area of said outer bag;

a second belt of hot-melt adhesive for sealing the outer bag to the body at a location spaced from said first belt adhesive;

said outer bag having a closed end spaced from said second belt of hot-melt adhesive; and said outer bag extending a predetermined distance from said belts of adhesive and being wrapped about the body outer surface to form a protective film over that outer surface and thereby isolate that surface.

2. A container assembly according to claim 1, further including a length of twine for sealing said upper open end.

3. A container assembly according to claim 1 further including a lifting tab capable of being lifted to form a groove at one lower end of said paper body.

4. A container assembly according to claim 1 wherein said container can be inserted into a conventional corrugated carton for easy transportation and water-proof package.

5. A container assembly according to claim 1 further including a hot-melt welding on said upper open end for sealing said plastic bag.

* * * * *